US005660388A

United States Patent [19]

Benn

[11] Patent Number: 5,660,388

[45] Date of Patent: Aug. 26, 1997

[54] METHOD FOR PLAYING A THREE DIMENSIONAL BOARD GAME

[76] Inventor: Arnold Benn, 3 Leatherwood, Irvine, Calif. 92715

[21] Appl. No.: 502,194

[22] Filed: Jul. 13, 1995

[51] Int. Cl.[6] ..... A63F 3/00

[52] U.S. Cl. ..... 273/241; 273/249

[58] Field of Search ..... 273/241, 248, 273/249, 258, 260, 261

[56] References Cited

U.S. PATENT DOCUMENTS

| | | | |
|---|---|---|---|
| 1,295,993 | 3/1919 | Kleissl | 273/241 |
| 1,572,254 | 2/1926 | Torunes | 273/249 |
| 3,767,201 | 10/1973 | Harper | 273/241 |
| 4,477,080 | 10/1984 | Baker | 273/241 |
| 4,842,282 | 6/1989 | Sciarra | 273/258 |
| 4,895,375 | 1/1990 | Blitz | 273/258 |
| 5,004,245 | 4/1991 | Schumacher | 273/241 |
| 5,033,751 | 7/1991 | Ching | 273/241 |
| 5,112,056 | 5/1992 | Ching | 273/241 |
| 5,306,016 | 4/1994 | McInnis | 273/258 |
| 5,338,040 | 8/1994 | Cutler | 273/241 |

OTHER PUBLICATIONS

Essentials of Modern Backgammon Copy Right Heines House 1975 pp. 1–11.

The Complete Book of Games by Clement Wood and Gloria Goddard, Copyright 1940 p. 338.

*Primary Examiner*—Benjamin H. Layno

*Assistant Examiner*—Stephen Luther Blau

*Attorney, Agent, or Firm*—Klein & Szekeres, LLP

[57] ABSTRACT

A board game comprises a board and a set of movable pieces for each of two players. The board is marked into a matrix of spaces forming a plurality of concentric perimeters, the innermost perimeter surrounding a single central space. Each perimeter comprises a separate level, the outermost perimeter being the lowermost level, and the central space forming the uppermost level. Each level has selected "jumping" spaces. A player may move a piece may only to an adjacent space on the same level, except when (1) the piece is on a jumping space, or (2) another piece is on an adjacent space on the same level, or (3) another piece is on adjacent space on the next higher level. When a piece is on a jumping space, it may jump to the immediately adjacent space on the next higher level. When another piece is on an adjacent space on the same level, the piece to be moved may jump over that piece to the next space on the same level. When another piece is on an adjacent space on the next higher level, the moving piece may jump over that piece to the next space one level above it. If the jumped-over piece is that of the opposing player, it may be moved to any unoccupied space on the lowest level. When a piece reaches the central space, it is removed from play. The first player to remove all of his or her pieces from play wins.

4 Claims, 4 Drawing Sheets

METHOD FOR PLAYING A THREE DIMENSIONAL BOARD GAME

BACKGROUND OF THE INVENTION

The present invention relates generally to the field of board games. More specifically, it relates to a game of strategy for two players, played on a three-dimensional board, with each player having a plurality of pieces that are moved from the periphery of the board toward the center in accordance with a predefined set of movement rules.

So-called "strategic" board games go back many centuries, with several, such as chess, checkers, and go, enjoying wide-spread and growing popularity. These games are characterized by relatively simple equipment, typically a board marked with designated spaces, and pieces that are moved in the spaces, in accordance with a predefined set of rules, toward a strategic objective, the attainment of which results in "victory" for one of the players. Typically, the game is for two players, each with an identical set of pieces, set up in strategically equal starting positions. Victory is achieved by moving the pieces toward the objective, using a logical analysis of possible moves for each player and his or her opponent. Thus, success is the result of mental acumen, rather than luck or chance.

While chess and checkers maintain their popularity, there is a significant demand for new strategic board games. In particular, there is a strong demand for new games that have relatively simple rules, so that a basic level of competence may be easily acquired, but that also permit the attainment of higher levels of skill as the game's strategy is mastered. In other words, the demand is for games that are easily learned by the novice, but that present an intellectual challenge to those who wish to attain a high degree of mastery. Another object for such games is that they readily lead to decisive outcomes, rather than inconclusive outcomes or draws, as is frequently the case in chess, for example. Furthermore, it is advantageous for such games to have relatively simple equipment, both for considerations of cost, and for advancing the end of simplicity of rules.

The prior art contains numerous examples of games that have sought to fulfill some or all of the above-mentioned criteria, with varying degrees of success. See, for example, U.S. Pat. No. 4,842,282—Sciarra; U.S. Pat. No. 5,033,751—Ching; U.S. Pat. No. 5,112,056—Ching; U.S. Pat. No. 5,306,016—McInnis; and U.S. Pat. No. 5,338,040—Cutler. Few, however, have fully achieved all of the aforementioned goals and the commercial success that might result.

SUMMARY OF THE INVENTION

Broadly, the present invention is a strategic board game, comprising a board and two sets of movable pieces, one set for each player, whereby each player moves his or her pieces from strategically equal starting positions near the edge of the board toward the center of the board, in accordance with a predetermined set of rules governing the movement of the pieces. Upon reaching the center of the board, a piece is removed from play, and the first player with all of his or her pieces thus removed from play wins.

In a specific embodiment, the board is marked into a pattern or matrix of spaces forming a plurality of concentric perimeters, extending from an outermost perimeter to an innermost perimeter, the latter surrounding a single central space. Each perimeter comprises a plurality of contiguous spaces. In a preferred embodiment, a three dimensional or multilevel board is used, wherein each perimeter comprises a separate level, the outermost perimeter being the lowermost level, and the central space forming the uppermost level or summit. Selected spaces, termed "jumping" spaces, are distinctively marked (by a contrasting color or distinctive indicia), with respect to the other spaces (which comprise the majority of spaces on the board).

The players alternate moves of one piece each. A piece may be moved only to an adjacent space on the same level, except when (1) the piece is on a jumping space, or (2) another piece is on an adjacent space on the same level, or (3) another piece is on adjacent space on the next higher level. When a piece is on a jumping space, it may jump to the immediately adjacent space on the next higher level. When another piece (the "stationary" piece) is on an adjacent space on the same level, the piece to be moved (the "moving" piece") may jump over the stationary piece to the space on the opposite side of the stationary piece on the same level. When the stationary piece is on an adjacent space on the next higher level, the moving piece may jump over the stationary piece to the space on the opposite side of the stationary piece one level above it. If the stationary piece is that of the opposing player, the player of the moving piece may move the stationary piece to any unoccupied space on the lowest level.

When a piece reaches the central space or summit, it is removed from play. The first player with all of his or her pieces removed from play wins the game.

DETAILED DESCRIPTION OF A PREFERRED EMBODIMENT

Figure 1:
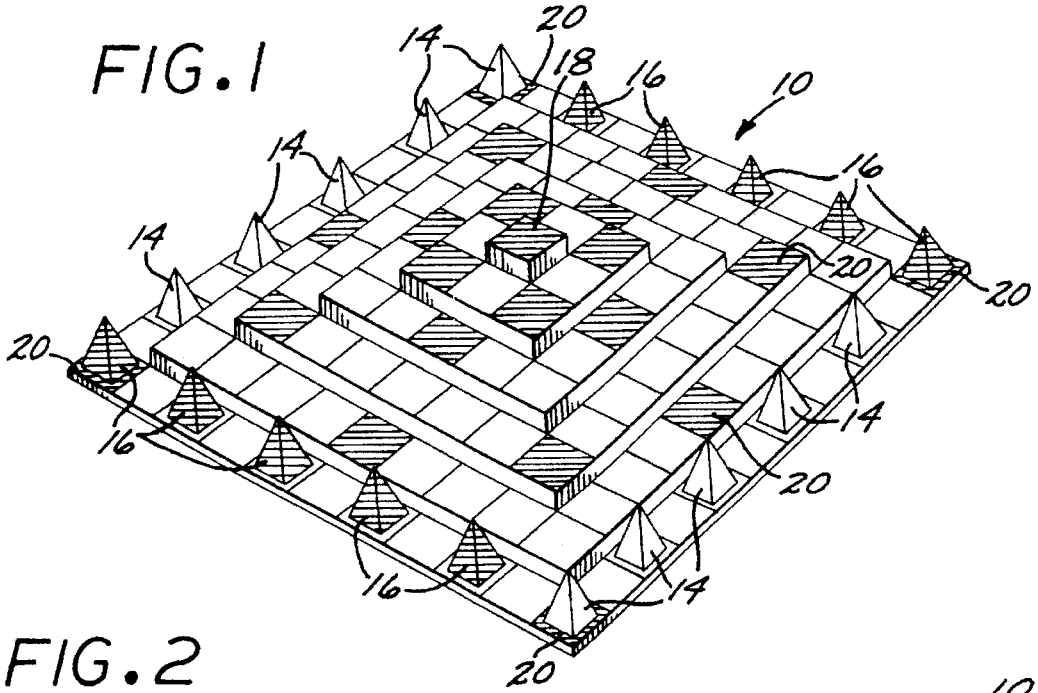
FIG. 1 is a perspective view of a three dimensional board game in accordance with a preferred embodiment of the invention, showing the game pieces in their starting positions.
Figure 2:
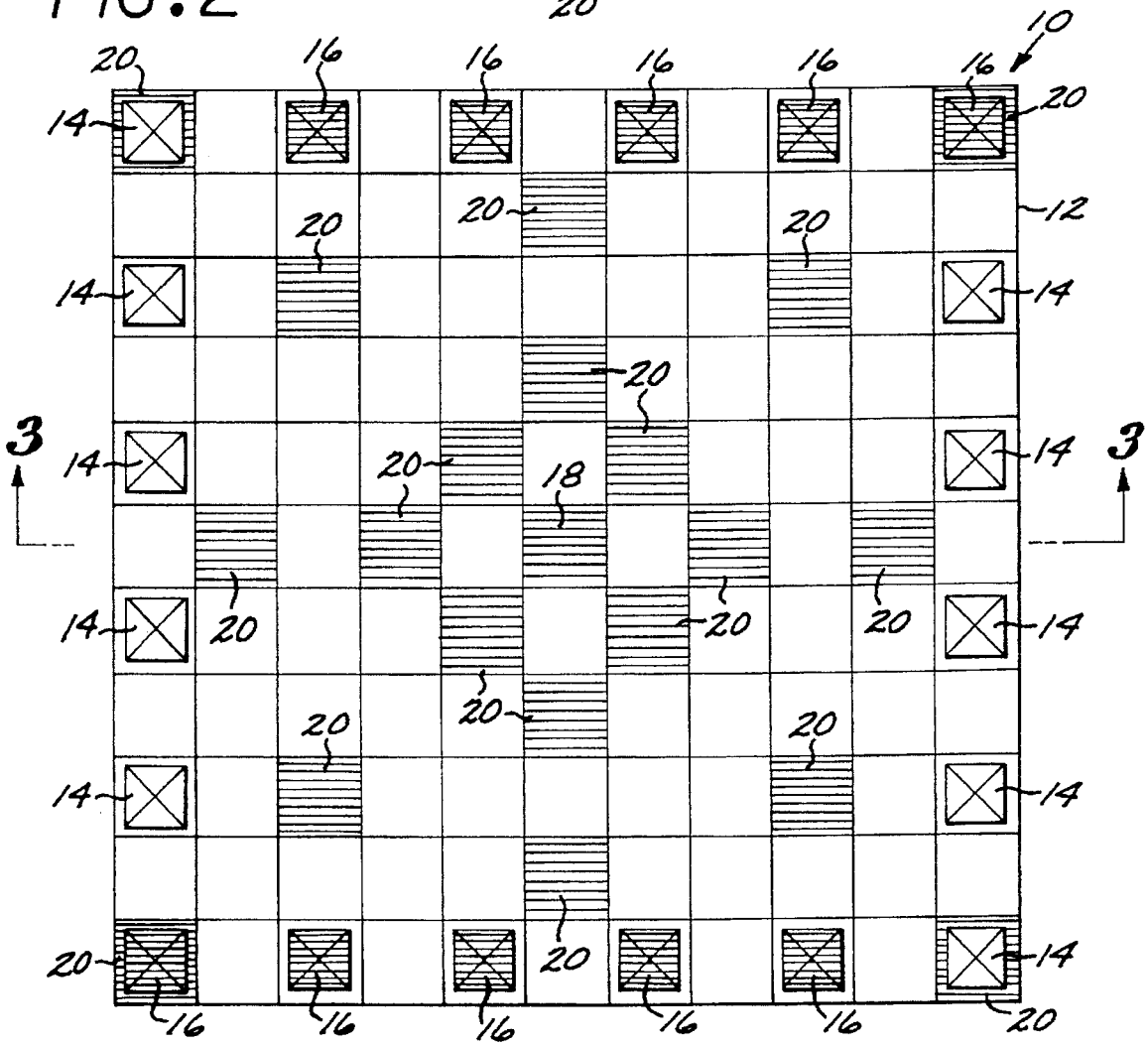
FIG. 2 is a top plan view of the game of FIG. 1, showing the pieces in their starting positions.
Figure 3:
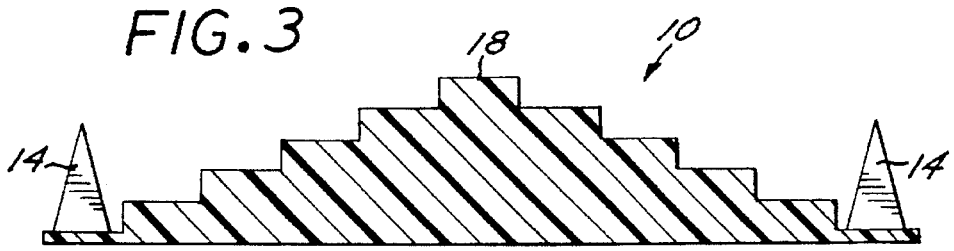
FIG. 3 is a cross-sectional view taken along line 3—3 of FIG. 2.

Referring first to FIGS. 1, 2, and 3, a three dimensional board game 10, in accordance with a preferred embodiment of the invention, is shown. The game 10 comprises a game board 12, a first set of tokens or pieces 14, and a second set of tokens or pieces 16. The board 12 is square in plan view, and is marked into a grid-like matrix or pattern of square spaces. In the illustrated embodiment, the board 12 is marked into an 11 by 11 matrix, for a total of 121 square spaces, but the number of spaces may be varied. The total number of spaces must be an odd number, however, because there must be a single central space, as will be explained below.

The pattern of the spaces forms a plurality of concentric perimeters, extending from an outermost perimeter to an innermost perimeter, the latter surrounding a single central 18. Each perimeter comprises a plurality of contiguous spaces. In the illustrated preferred embodiment, the game board 12 is a three dimensional or multilevel board comprising a series of progressively higher levels, wherein each perimeter comprises a single, distinct level, the outermost perimeter being the lowermost level, and the central space 18 forming the uppermost level or summit. The board 12 thus resembles a stepped pyramid, or ziggurat, as best shown in FIG. 3. Alternatively, the board 12 can be a planar, two dimensional board, with all perimeters being on the same plane, but it is believed that using a multi-level board provides more visual appeal and interest. (On the assumption that a multi-level board 12 is used, the description that follows will use the term "level" in referring to each perimeter.) Each level includes several selected spaces 20, termed "jumping" spaces, that are distinctively marked (by a contrasting color or distinctive indicia), with respect to the other spaces (which-comprise the majority of spaces on the board). In the illustrated square embodiment, the outermost (lowermost) level, and every alternate level (including the innermost or uppermost level) includes a jumping space 20 at each corner, while the remaining levels have a jumping space 20 as the middle space on each side (all sides of all levels having an odd number of spaces).

The pieces 14 in the first set are visually distinct from the pieces 16 in the second set. In the illustrated embodiment, all of the pieces are of the same shape (right pyramids), and the two sets are distinguished by color, the pieces 14 in the first set being white or a light color, and the pieces 16 being black or a dark color, such as blue. Alternatively, the pieces in the two sets can be distinguished by different shapes.

The game is played by two players. In the illustrated 121 square space embodiment, each player is given one set of ten pieces. The strategically neutral starting position of the pieces 14, 16 at the beginning of the game is illustrated in FIGS. 1 and 2. The pieces 14 of the first set are set on alternating spaces on the outermost level on two opposing sides of the board 12, with one piece on each side resting on a corner jumping space 20. The pieces 16 of the second set are similarly arranged on the outermost level on the two remaining opposing sides of the board 12.

Figure 4:
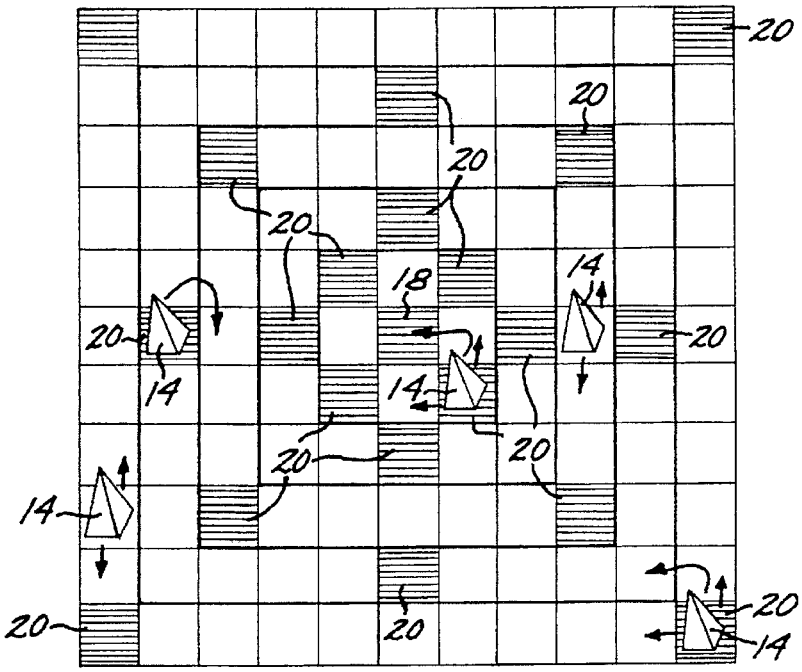
FIG. 4 is a top plan view of the game of FIG. 1, with most of the pieces removed for clarity, showing how the pieces may be moved laterally on the same level.
Figure 5:
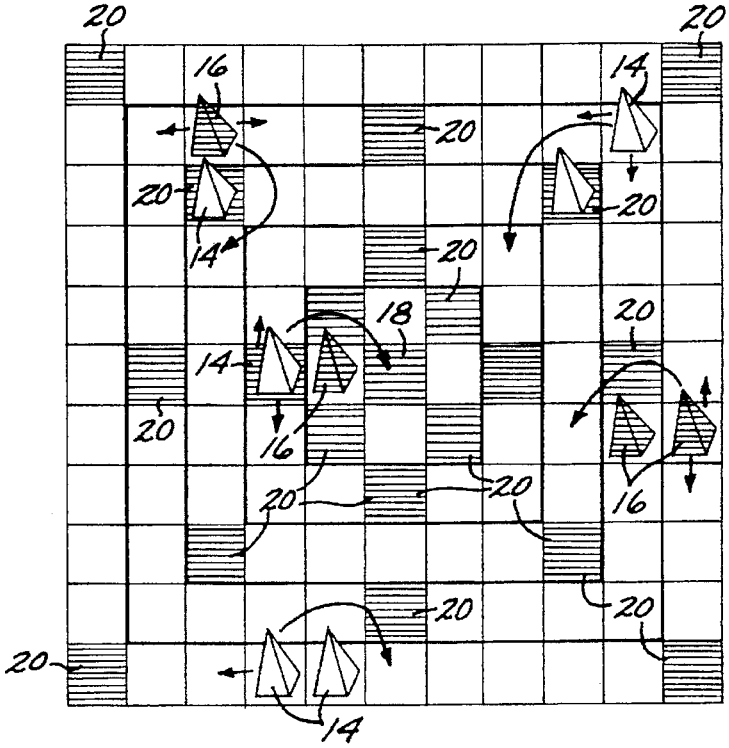
FIG. 5 is a top plan view of the game of FIG. 1, with most of the pieces removed for clarity, showing how the pieces may be jumped to a higher level.

Movement of the pieces 14, 16 is governed by a predetermined set of rules, as illustrated in FIGS. 4 and 5, and described as follows:

The players alternate moves of one piece each. The arrows in FIGS. 4 and 5 show the permitted moves of the pieces 14, 16, whereby a piece may be moved only to an adjacent space on the same level, except when (1) the piece is on a jumping space 20, or (2) another piece is on an adjacent space on the same level, or (3) another piece is on adjacent space on the next higher level. When a piece is on a jumping space 20, it may jump to the immediately adjacent space on the next higher level. When another piece (the "stationary" piece) is on an adjacent space on the same level, the piece to be moved (the "moving" piece") may jump over the stationary piece to the space on the opposite side of the stationary piece on the same level. When the stationary piece is on adjacent space on the next higher level, the moving piece may jump over the stationary piece to the space on the opposite side of the stationary piece one level above it. If the stationary piece is that of the opposing player, the player of the moving piece may move the stationary piece to any unoccupied space on the lowest level. If, however, the space to which the moving piece would jump is already occupied, the jump cannot be made. Of course, even if a piece is permitted to jump to another level or over an adjacent piece on the same level, the moving piece may be moved to an adjacent unoccupied space on the same level, although such a move will not usually be strategically advisable. Pieces are not, however, permitted to jump or move to a lower level.

Figure 6:
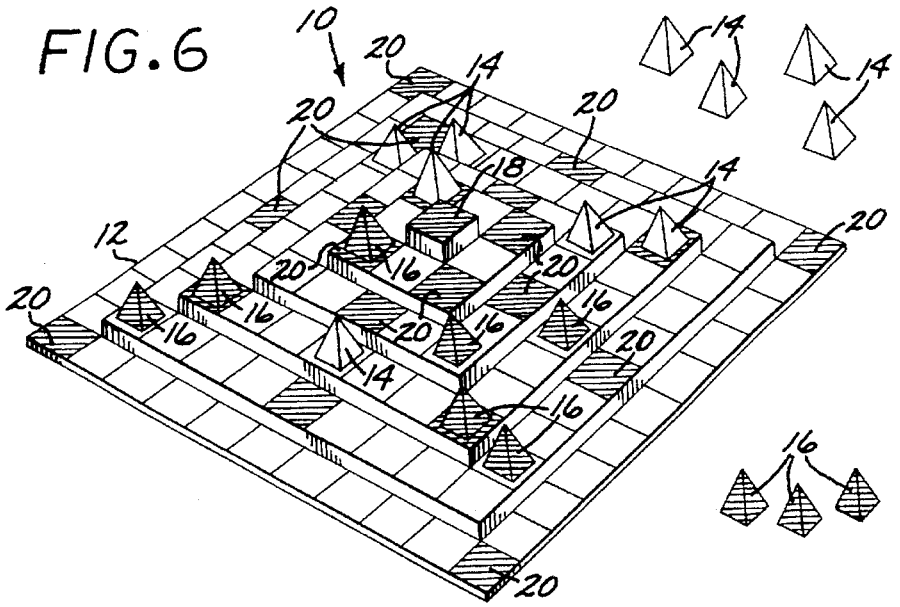
FIG. 6 is a perspective view, similar to FIG. 1, showing a typical arrangement of pieces during the course of a game.
Figure 7:
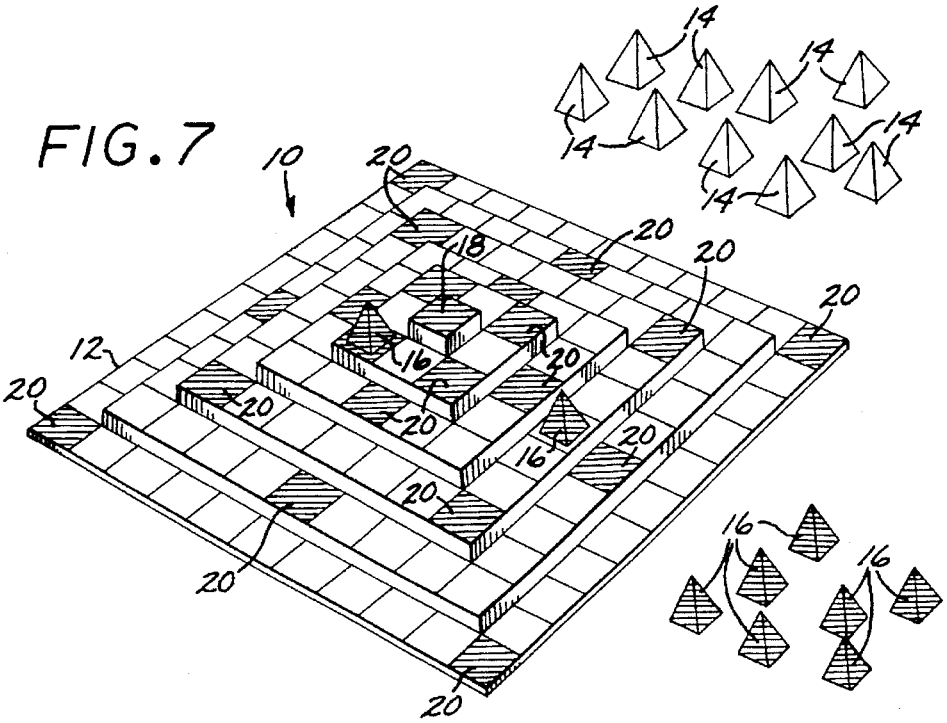
FIG. 7 is a perspective view, similar to FIG. 6, showing one possible arrangement of pieces after one player has won the game.

When a piece reaches the central space or summit 18, it is removed from play. FIG. 6 shows a typical situation in mid-game, in which each of the players has thus removed several pieces from play. The first player with all of his or her pieces removed from play wins the game. Such an end game situation is illustrated in FIG. 7, which shows that the player with the first set of pieces 14 (white) has all pieces removed from play, while the player with the second set of pieces 16 (dark) has one piece left on the board. Thus, the player of the first set of pieces 14 has won.

Figure 8:
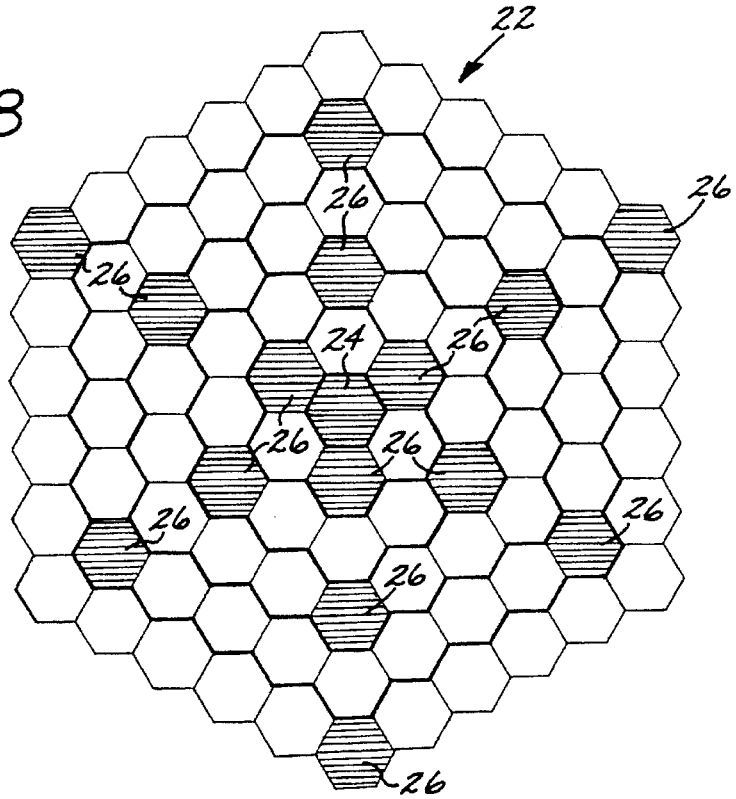
FIG. 8 is a top plan view of an alternative configuration of a three dimensional game board for use with the game of the present invention.

FIG. 8 illustrates a game board 22 having a first alternative configuration, in this case a hexagon. The first alternative game board 22 is divided into a matrix or pattern of hexagonal spaces, with the pattern forming a plurality of concentric perimeters or levels, culminating in an innermost perimeter (uppermost level) surrounding a single central space or summit 24. Several spaces on each level are marked as jumping spaces 26. The game is played on the first alternative board 22 with essentially the same rules as those described above, with each player having a distinctively configured or colored set of pieces (not shown). One difference is that the hexagonal configuration is conducive to three-handed play, if desired, requiring three sets of pieces.

Figure 9:
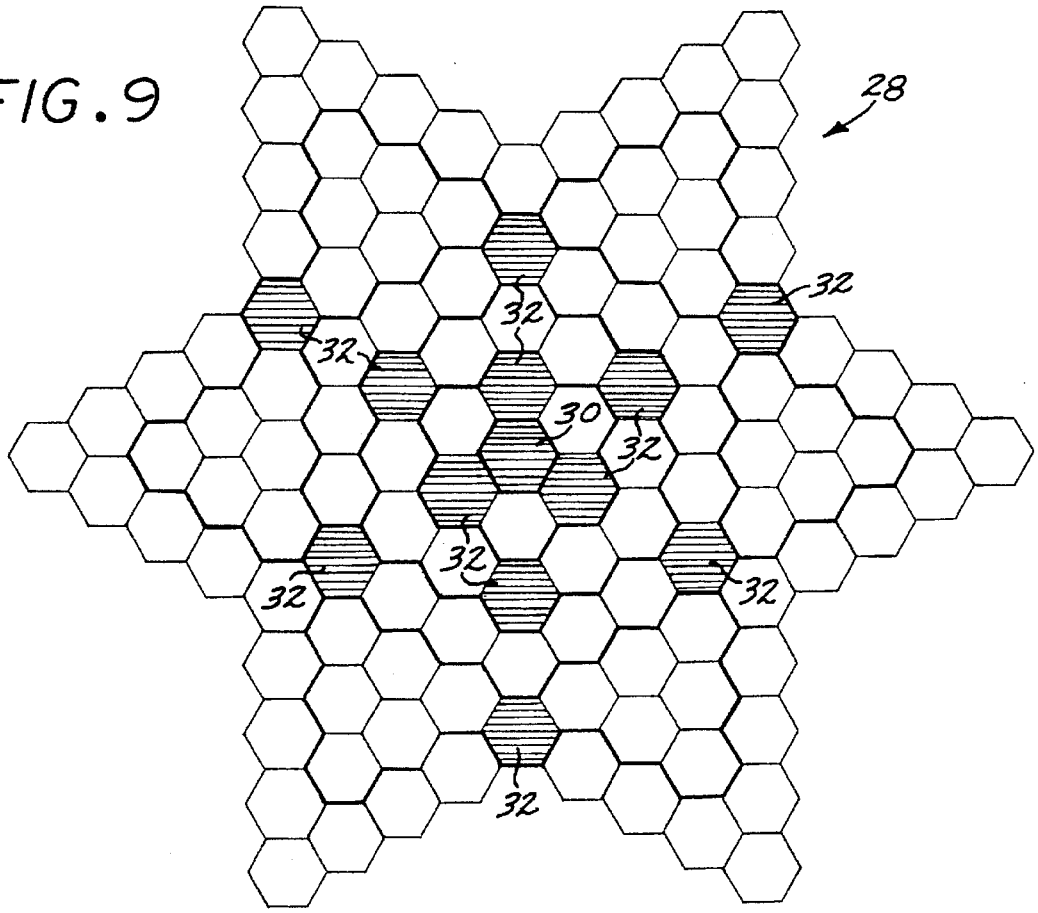
FIG. 9 is a top plan view of another alternative configuration of a three dimensional game board for use with the game of the present invention.

FIG. 9 illustrates a game board 28 having a second alternative configuration, in this case a hexagram. The second alternative game board 28 is divided into a matrix or pattern of hexagonal spaces, with the pattern forming a plurality of concentric perimeters or levels, culminating in an innermost perimeter (uppermost level) surrounding a single central space or summit 30. Several spaces on each level are marked as jumping spaces 32. The game is played on the first alternative board 28 with essentially the same rules as those described above, with each player having a distinctively configured or colored set of pieces (not shown). Like the above-described hexagonal configuration of FIG. 8, the hexagram configuration of FIG. 9 is conducive to three-handed play, if desired, requiring three sets of pieces.

The above-described strategic board game will thus be appreciated to have a number of advantageous features: (1) It may be easily and inexpensively constructed. Both the board and pieces may be made of molded plastic, for example. (2) While the rules are easily learned, mastery of the game requires analytical skill. (3) Strategy, rather than luck, determines the outcome. (4) The outcome is typically a decisive victory for one of the players, rather than a draw.

While a preferred embodiment of the invention has been described, along with several variations, it will be appreciated that further variations and modifications may suggest themselves to those skilled in the pertinent arts. For example, other board configurations, besides those described herein, may be used. Also, the number and pattern of the jumping spaces may be altered, as may be the number and style of the movable pieces, and the and the total number and configuration of the board spaces. These and other variations and modifications that may suggest themselves should be considered within the spirit and scope of the invention, as defined in the claims that follow.

What is claimed is:

1. A method of playing a board game by first and second players, comprising the steps of:

(a) providing a game board marked into a pattern of spaces forming a pattern of concentric perimeters, extending from an outermost perimeter to an innermost perimeter, the innermost perimeter surrounding a central space, each perimeter comprising a plurality of contiguous spaces, at least one space of which is distinctively marked as a jumping space;

(b) providing a first plurality of movable pieces for movement on the board by the first player from starting positions in spaces on the outermost perimeter toward the central space;

(c) providing a second plurality of movable pieces for movement on the board by the second player from starting positions in spaces on the outermost perimeter toward the central space;

(d) moving a piece selected alternately from the first and second pluralities in accordance with a predetermined set of rules toward the central space; and (e) repeating the moving step until all of the pieces of one of the pluralities are moved to the central space;

wherein the moving step comprises the steps of:

(d)(1) moving a piece selected alternately from the first and second pluralities only along a single perimeter until it lands on either (i) a jumping space, or (ii) a space immediately adjacent a space occupied by a stationary piece;

(d)(2) when the selected piece lands on a jumping space, moving the selected piece to the immediately adjacent space on the next innermost perimeter, unless the latter space is occupied by another piece;

(d)(3) when the selected piece lands on a space immediately adjacent a stationary piece on the next innermost perimeter, jumping the selected piece over the stationary piece to the space on the opposite side of the stationary piece on the perimeter next innermost from the stationary piece, unless the latter space is occupied by another piece; and (d)(4) when the selected piece lands on a space immediately adjacent to a stationary piece on the same perimeter, jumping the selected piece over the stationary piece to the space on the opposite side of the stationary piece on the same perimeter, unless the latter space is occupied by another piece; and wherein the set of rules includes a first rule that a piece in either plurality of pieces may not be moved from one perimeter to a perimeter that is farther away from the central space unless it is a piece that is jumped over by another piece that is not in the same plurality of pieces, and a second rule that a stationary piece that is jumped over by the selected piece remains in play on the game board.

2. The method of claim 1, wherein the stationary piece that is jumped over by the selected piece is moved to an unoccupied space on the outermost perimeter if the stationary piece and the selected piece are not in the same plurality of pieces.

3. The method of claim 2 wherein each perimeter is on a separate level, the outermost perimeter defining the lowermost level and the central space defining the uppermost level.

4. The method of claim 1, wherein each perimeter is on a separate level, the outermost perimeter defining the lowermost level and the central space defining the uppermost level.

* * * * *